US006019375A

United States Patent [19]

West, Jr.

[11] Patent Number: 6,019,375

[45] Date of Patent: Feb. 1, 2000

[54] LAYERED TARGET ASSEMBLY AND METHOD OF CONSTRUCTION THEREOF

[76] Inventor: Joseph Arnold West, Jr., 6105 Cottonwood, Pearland, Tex. 77584

[21] Appl. No.: 09/144,788

[22] Filed: Sep. 1, 1998

[51] Int. Cl.[7] ..... F41J 5/00

[52] U.S. Cl. ..... 273/378; 273/408; 434/21

[58] Field of Search ..... 273/348, 378, 273/408, 409; 434/21–23; 359/529, 515

[56] References Cited

U.S. PATENT DOCUMENTS

| | | | |
|---|---|---|---|
| 3,895,803 | 7/1975 | Loe | 273/378 |
| 3,899,175 | 8/1975 | Loe | 273/378 |
| 4,810,561 | 3/1989 | King | 273/409 |
| 5,073,005 | 12/1991 | Hubbs | 350/96 |
| 5,186,468 | 2/1993 | Davies | 273/378 |
| 5,188,371 | 2/1993 | Edwards | 273/378 |
| 5,501,467 | 3/1996 | Kandel | 273/378 |
| 5,589,981 | 12/1996 | Kasser et al. | 359/529 |

*Primary Examiner*—Mark S. Graham
*Attorney, Agent, or Firm*—Maryam Bani-Jamali

[57] ABSTRACT

A layered target assembly is disclosed for improved shooting practice which provides for a first planar layer, a second planar layer, and a third planar layer. The first planar layer preferably consists of a paper material to provide a relatively rigid support for the second planar layer and the third planar layer. The second planar layer preferably consists of a reflective sheet of metallic foil. The third planar layer covers the second planar layer and is translucent such that light easily passes therethrough for reflection from the second planar layer. The third planar layer is highlighted by the reflected light so that a laser dot is visible on the layered target assembly of the present invention even during bright ambient light conditions. The first planar layer, second planar layer, and third planar layer each have respective planar surfaces that are approximately equal in size. Means may be provided for filtering light within the layered target assembly, such as use of a tinted metallic foil for the second planar layer or use of a fourth planar layer that forms a color filter, to thereby reflect light of a specific color. The color filter or tint of the metallic foil may be the same color as the laser beam to reinforce the color of the laser beam so as to make the laser dot so produced on the layered target assembly easier to see.

20 Claims, 2 Drawing Sheets

LAYERED TARGET ASSEMBLY AND METHOD OF CONSTRUCTION THEREOF

BACKGROUND OF THE INVENTION

1. Field of the Invention

The present invention relates generally to rifle and pistol shooting practice target assemblies and, more particularly, to apparatus and method for facilitating improved target visibility.

2. Description of the Background

While conventional paper targets are typically lightweight, of relatively low cost, and of selectable size, they give rise to problems during shooting practice under certain ambient lighting situations and for certain types of pistol or rifle sighting methods. For instance, many modem pistols and rifles have laser pointers attached thereto for accurate aiming. In bright light conditions, such as bright sunshine, the dot produced on the target by the laser pointers may wash out so as to become indiscernible from a relatively short distance to the target. For instance, the laser sighting dot may wash out at a distance as short as fifteen yards in bright light depending on the power, color and type of the laser pointer. Thus, in bright light conditions, laser sighting becomes problematic with conventional paper targets.

On the other hand, for more traditional target shooting without using laser pointers, conventional paper targets become quite difficult to see and/or distinguish from the background in dim lighting conditions such as heavy cloud cover or dusk. Such conditions may also occur when the shooter is in bright sunlight and the targets are in a shaded area. Other situations where the target becomes difficult to see may depend on the various angles of the sun, the general terrain of the target area, and the orientation of the target shooting area to the sun.

The following patents relate to laser reflection but do not teach a suitable lightweight, very low cost target that is useable for target practice under a wide range of lighting conditions for which paper targets are unsuitable.

U.S. Pat. No. 5,589,981, issued Dec. 31, 1996, to Kasser et al., discloses a retro-reflective target for laser ranging embodying at least one hollow cube comer retro-reflector constituted by three reflective surfaces which are substantially planar and perpendicular to each other and intersect at an apex with the cube corner retro-reflector being associated with a geometrical normal at the same angle to each of the edges.

U.S. Pat. No. 5,073,005, issued Dec. 17, 1991, to W. O. Hubbs, discloses a target for use in photogrammetry and automated theodolite systems comprising a rigid body having a support surface, a retro-reflective member comprising a tape-forming substrate having normally a rearward surface and a forward surface with an adhesive provided on the rear surface thereof for securing the same to the support surface of the target, and a mask-forming member having a rearward surface and a forward surface, the mask forming member is of greater area than that of the retro-reflective tape and the light reflective means provided thereon.

U.S. Pat. No. 5,591,032, issued Jan. 7, 1997, to Powell et al., discloses a laser weapon simulator apparatus for practice in the shooting of a firearm at a target having reflective material thereon including a laser beam transmitter that is actuable to emit a laser beam of short duration, a laser beam receiver for collecting and processing a reflected portion of the laser beam, circuitry for detecting the emission of the laser beam by the transmitter and a visual display.

The above background art does not provide for a low cost practice target assembly that offers more dependable visibility in a wide range of lighting conditions and for use with or without a laser pointer. Those skilled in the art have long sought and will appreciate the present invention which provides solutions to these and other problems.

SUMMARY OF THE INVENTION

The layered target assembly of the present invention may be used to increase visibility of the target under a wide range of lighting conditions. The present invention is useful for practice shooting both with and without a laser pointer. In accordance with the present invention, a shooting practice target assembly comprises a number of planar layers positioned closely adjacently to each other. In a preferred embodiment, three lightweight planar layers are used and are referred to as a first planar layer, a second planar layer and a third planar layer. The first planar layer, second planar layer, and third planar layer each have a respective planar surface and each respective planar surface has an approximately equal surface area. The first planar layer consists of a relatively rigid planar sheet that is sufficiently rigid to be capable of supporting the second planar layer and the third planar layer. The second planar layer is positioned between the first planar layer and the third planar layer. The respective planar surface of the second planar layer comprises a reflective sheet such as metallic foil. The third planar layer comprises a sufficiently translucent sheet, such as wax paper, to allow light to pass therethrough for reflection from the surface of the second planar layer. When the reflected light from the second planar layer re-enters the translucent sheet of the third planar layer, the translucent sheet thereof is illuminated so as to effectively illuminate the layered target assembly. Thus, a laser beam will then produce a significant bright spot on the layered target assembly that can be seen at a distance much more easily than with a standard paper target, especially during bright ambient conditions. As well, in dim conditions the layered target assembly will trap and focus enough light so that the layered target assembly is considerably brighter and more discernible than a standard paper target.

In another embodiment, a fourth planar layer is positioned between the second planar layer and third planar layer. The fourth planar layer comprises a colored translucent and transparent material for passing light of a desired color through the fourth planar layer so as to enhance a particular color thereby increasing contrast in the target. In another embodiment, the second planar layer is tinted such that light of a desired color is more readily reflected by the second planar layer.

The second planar layer preferably, but not necessarily, consists of a metallic foil. The third planar layer preferably, but not necessarily, consists of wax paper. The first planar layer preferably, but not necessarily, consists of a paper product.

An adhesive layer may be used between the first planar layer and the second planar layer for securing the first planar layer and second planar layer together. The first planar layer and second planar layer may be attached by glue. As well, a binding, similar to a book binding, along at least one outer edge of the first planar layer, at least one corresponding outer edge of the second planar layer and at least one corresponding outer edge of the third planar layer may be used for securing the first planar layer, the second planar layer and the third planar layer together.

A method for construction of the layered target assembly comprises providing the first planar layer consisting of a relatively rigid planar sheet, affixing the second planar layer consisting of a sheet having a reflective planar surface to one side of the first planar sheet, and affixing the third planar layer consisting of a sheet of translucent material to the first planar layer such that the second planar layer is positioned between the third planar layer and the first planar layer. As noted above, the third planar layer comprises a sufficiently transparent material for allowing light to pass through the third planar layer for being reflected from the reflective second planar layer. The step of affixing the third planar layer further comprises binding the third planar layer, the first planar layer and the second planar layer to each other.

It is an object of the present invention to provide an improved target assembly and method of construction thereof.

It is another object of the present invention to provide a layered target assembly that can be used for target practice in various lighting conditions for both laser and more conventional sighting.

It is yet another object of the present invention to provide a layered target assembly that reflects more light and yet is of low cost.

A feature of the present invention is layered construction whereby each layer performs a function that has a combined effect of producing a more readily visible, lowcost target.

Another feature of the present invention is a planar construction with each layer on top of another layer whereby one layer provides support, another layer is translucent and another layer is reflective.

An advantage of the present invention is a low-cost target that is easily constructed using readily available, inexpensive materials.

Another advantage is that the present invention may be made in any desired size.

These and other objects, features, and advantages of the present invention will become apparent from the drawings, the descriptions given herein, and the appended claims.

Figure 1:
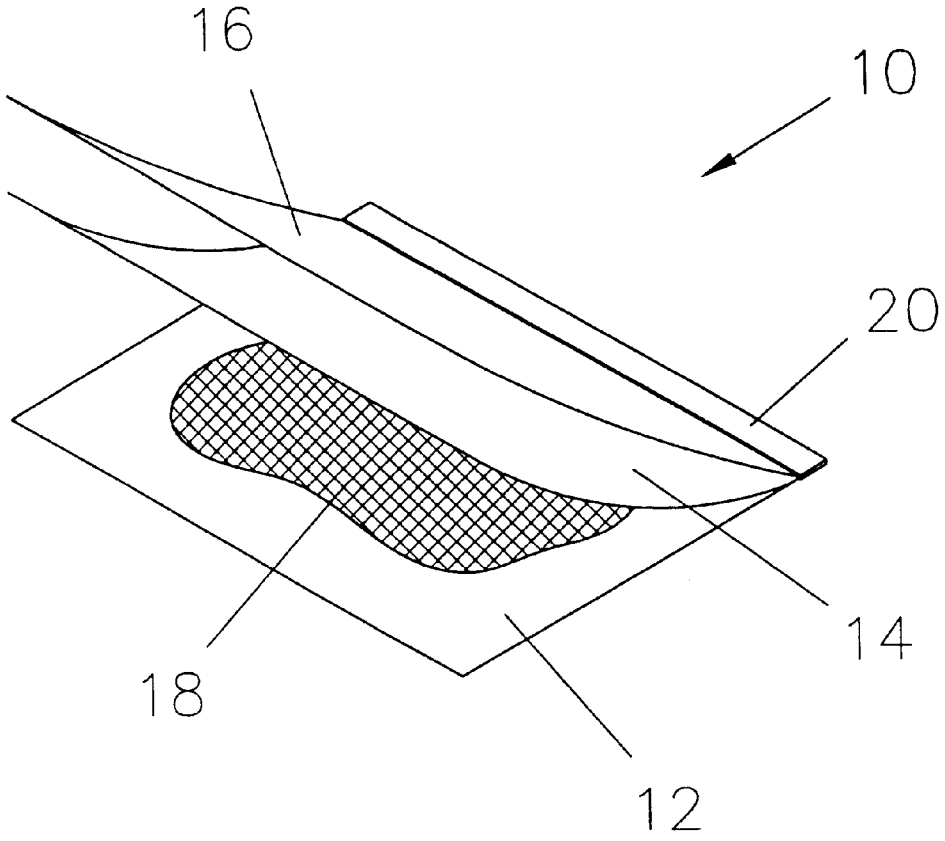
FIG. 1 is a perspective view of a layered target assembly in accord with the present invention shown with respective layers spread out for easier viewing.

While the present invention will be described in connection with presently preferred embodiments, it will be understood that it is not intended to limit the invention to those embodiments. On the contrary, it is intended to cover all alternatives, modifications and equivalents included within the spirit of the invention and as defined in the appended claims.

DETAILED DESCRIPTION OF THE PREFERRED EMBODIMENTS

Referring now to the drawings, a generally preferred arrangement of a layered target assembly 10 comprising a number of planar layers, in accord with the present invention, is illustrated.

Figure 2:
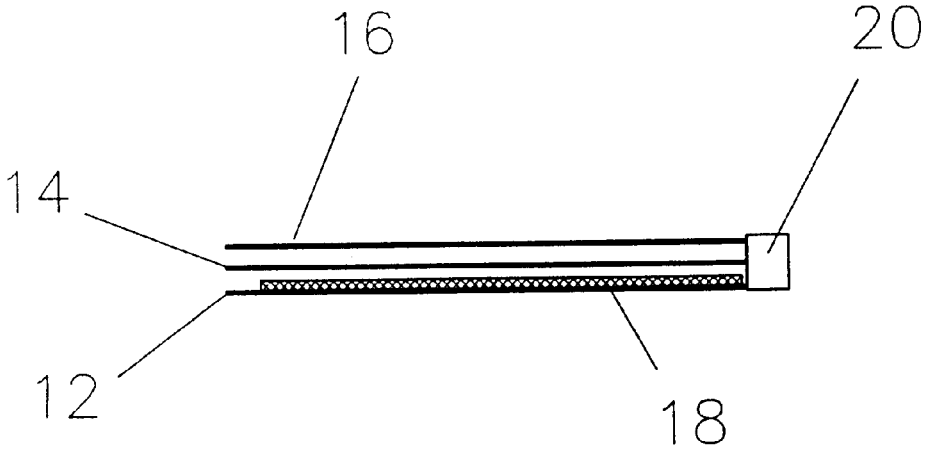
FIG. 2 is an elevational side view of the layered target assembly of FIG. 1 with the layers closed upon each other as would be the typical position during target practice.

In a preferred embodiment (shown in FIG. 1 and FIG. 2), the number of layers comprises a first planar layer 12, a second planar layer 14 and a third planar layer 16 of the layered target assembly 10. While FIG. 1 shows first planar layer 12, second planar layer 14, and third planar layer 16 of the layered target assembly 10 fanned outwardly for easier viewing, the typical position of the first planar layer 12, second planar layer 14, and third planar layer, 16 of the layered target assembly 10 when used for target practice are flat against each other as shown in FIG. 2. The first planar layer 12, second planar layer 14, and third planar layer 16 are preferably lightweight and planar. By lightweight is meant that the weight of first planar layer 12 is close to weight of cardboard or paperboard of the desired size. The weight of the second planar layer 14 is close to weight of a sheet of metallic foil such as aluminum or tin of the desired size. The weight of the third planar layer 16 is close to weight of a sheet of wax paper of the desired size. Typically tin foil and wax paper weigh substantially less than an ounce for a sheet that is eight and one-half inches by twelve inches. Card board would tend to weigh less than two ounces for a sheet of eight and one-half inches by twelve inches. Thus, the layered target assembly 10 of the present invention would typically weigh less than about four ounces for a size of a standard sheet of paper and probably weigh in the range of two and one-half ounces to three ounces per hundred square inches. Furthermore, each respective planar layer is quite thin with respect to the length and height dimensions thereof, just as is a sheet of metallic foil, wax paper and cardboard. The light weight of the layered target assembly 10 enables easy transportation and storing of the layered target assembly 10. Preferably, each planar layer 12, 14, 16 has a surface with a surface area that is approximately equivalent to the area of the layered target assembly 10. As well, each planar layer 12, 14, 16 comprises inexpensive material so that the overall cost of the layered target assembly 10 is quite low.

In the presently preferred embodiment, the first planar layer 12 serves as a support layer that is sufficiently rigid or stiff to support the relatively supple second planar layer 14 and third planar layer 16. To this purpose, the first planar layer 12 may preferably comprise a paper product such as cardboard, paper board, and the like. If desired, a standard paper target may be used for the first planar layer 12 assuming it is one that is relatively sturdy so as to prevent excessive bending of the layered target assembly 10 during a breeze or the like that may occur during normal target practice conditions. In this embodiment of the invention for standard purposes, it is also desirable for the first planar layer 12 to be lightweight and thin so that use of layered target assembly 10 is just as easy and convenient as use of a standard paper target.

The second planar layer 14 preferably provides the reflective medium of the presently preferred embodiment of the invention. To this end, the second planar layer 14 preferably comprises a metallic foil such as a sheet of tin foil or of aluminum foil. Although other types of reflective medium could be used, tin foil material is especially suitable for low cost and easy construction of a layered target. In a preferred embodiment, the tin foil is smooth and relatively free of wrinkles. However, for some types of reflection results it may be desirable that the tin foil is wrinkled so that effectively a large number of tiny reflective surfaces are inexpensively produced thereby.

Since tin foil is not particularly sturdy or stiff, it is desirable to have a means for holding it in a flat, rigid position. Therefore, the second planar layer 14 is supported by the first planar layer 12. A presently preferred means of securing the second planar layer 14 to the first planar layer 12 is an adhesive material 18 that may be spread out over or attached to a relatively large portion of first planar layer 12 as indicated in FIGS. 1–4. Alternatively, the adhesive material 18 may be used in spots that are spread out over the surface of the first planar layer 12 so that collectively the spots of the adhesive material 18 securely fasten the second planar layer 14 to the first planar layer 12. The overall effect is that the adhesive material 18 is easily applied for securing most or all of the second planar layer 14 to the first planar layer 12. The adhesive material 18 should be one that is easily and quickly applied. The adhesive material 18 could be brushed or sprayed on or otherwise applied. The first planar layer 12 could be paperboard that has a layer of the adhesive material 18 placed thereon during manufacture. The adhesive material 18 could be of many types including glue or paint. It will be understood that other means for securing the second planar layer 14 to the first planar layer 12 might also be used such as staples, clamps, paperclips and the like. The second planar layer 14 is positioned between the first planar layer 12 and the third planar layer 16. In a preferred embodiment (not shown in the drawings), the second planar layer 14 is attached to the third planar layer 16 by applying the adhesive material 18 between the second planar layer 14 and the third planar layer 16. Other means for securing the second planar layer 14 to the third planar layer 16 might also be used such as staples, clamps, paperclips and the like. In some cases, it may be desirable to have a tinted reflective surface for the second planar layer 14 so that a particular light color, such as the color of the laser beam, is more readily apparent to thereby stand out on the layered target assembly 10. One way to effect the tinted reflective surface is to use a colored reflective material, consisting of a tinted metallic foil such as an aluminum foil, as the second planar layer 14. Other ways to effect this are discussed below.

The third planar layer 16 is preferably comprised of a translucent material, such as a sheet of wax paper, that is sufficiently transparent to allow light to pass through readily. The sheet of wax paper allows light to pass through for reflection but then tends to focus or trap a large amount of the reflected light within the third planar layer 16 to thereby illuminate the layered target assembly 10. The wax paper has a different light index of refraction than air and/or cloudiness that thereby tends to trap or focus or diffuse the reflected light, thus producing a more readily visible or highlighted target. While wax paper is the presently preferred material any material that does effect such trapping such as colored wax paper, a translucent plastic sheet, a colored plastic sheet or the like could be used to effect the present invention. In some cases where light is otherwise collected by the layered target assembly 10 such as when wrinkled aluminum foil is used or other layers are provided as discussed below, it may be desirable that the third planar layer 16 is clear and transparent. In any event, wax paper is of very low cost and is easily assembled to make an inexpensive layered target assembly 10 in accord with the present invention.

During use of the layered target assembly 10, whether the light is from the ambient light in low light conditions or is produced by a laser beam in bright light ambient conditions, the reflected light illuminates the layered target assembly 10 or a portion thereof considerably more visibly than a standard paper target. Note that reflective material from the second planar layer 14 and refractive material of the third planar layer 16 may be effectively manufactured as a one piece item with two layers secured together, if desired. However for the preferred embodiment of the present invention, the low cost of manufacture is presently believed to be best accomplished with three separate sheets made of the materials as indicated hereinbefore and attached together by the adhesive material 18.

Various binding means 20 may be used to bind, causing a sticking of, the first planar layer 12, second planar layer 14 and third planar layer 16 together. The binding means 20 provides a simple means for securing the first planar layer 12, second planar layer 14 and third planar layer 16 together in a stacked manner such that they overlay each other. The binding means 20 may be of various types and may be of a reusable type of binding, if desired. The binding means 20 may be similar to bindings used for books or folders, may be of a clamp type, may be an adhesive material 18 used between adjacent layers, may consist of clips, nails, staples and other holding means (not shown in the drawings) or other means for securing layers together. Such binding means 20 are readily available and may be found in printing shops, office supply warehouses and the like. While only one type of binding means 20 is necessary to hold the first planar layer 12, second planar layer 14 and third planar layer 16 together, various binding means 20 may be used in combination. In the most preferred embodiment, the binding means 20 consists of an adhesive material 18 used between adjacent layers. In another preferred embodiment the binding means 20 consists of bindings or clamps used for holding the number of layers together. Holding means, consisting of nails, staples and clips (not shown in the drawings), may also be used as the binding means 20. The target assembly 10 may be hung for target practice with the binding means 20 at the top so that all respective layers hang downwardly. The adhesive material 18 may consist of adhesives, adhesive tape such as double or single sided tape and the like.

Figure 3:
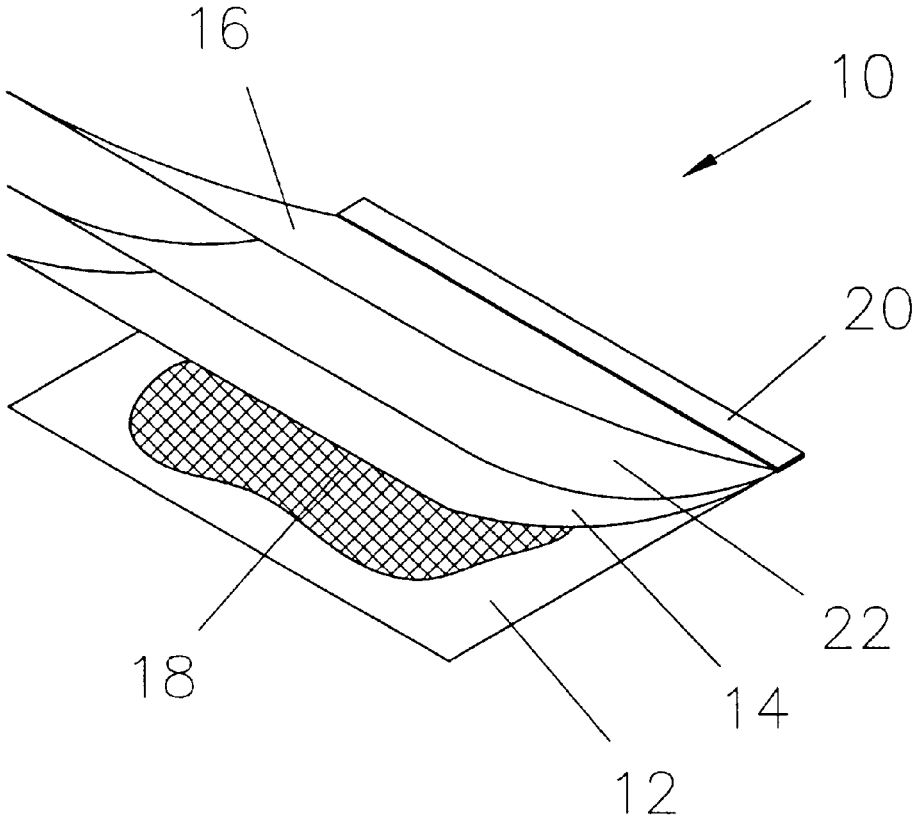
FIG. 3 is a perspective view of an embodiment of a layered target assembly having an additional filter layer.
Figure 4:
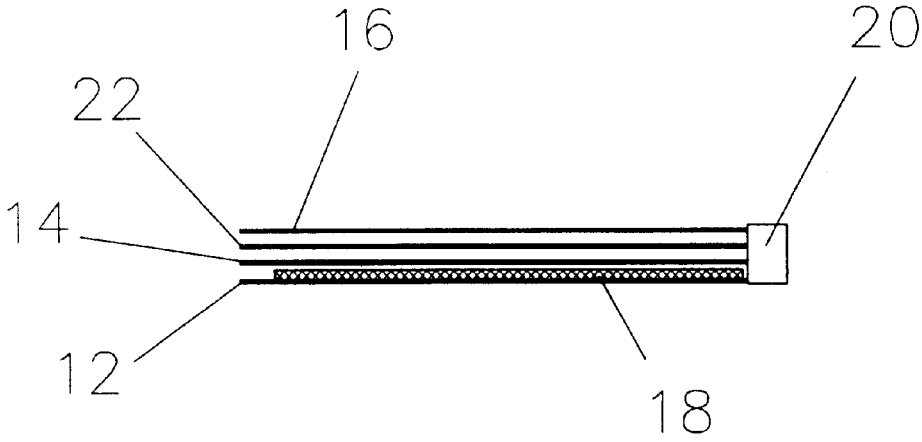
FIG. 4 is an elevational view of the layered target assembly of FIG. 3.

FIG. 3 and FIG. 4 disclose another embodiment of the layered target assembly 10. In this embodiment, an additional layer serving as a fourth planar layer 22 is added between the second planar layer 14 and the third planar layer 16. The fourth planar layer 22 is a translucent or sufficiently transparent colored filter so that a particular color of light is predominately reflected as discussed above. Such colored filter is readily available from office supply or paper supply locations and is preferably a sheet of flexible plastic-like colored translucent material. Thus, this embodiment discloses another means for reflecting a dominant color that may be more readily visible. For instance, it may be desirable to have a red filter for enhancing reflection of a red laser pointer while reducing reflection of other colors thus making the red dot so produced more readily visible. FIG. 4 discloses how the layered target assembly 10 of the present invention will appear when hung so that the binding means 20 is positioned on top such that all layers 12, 14, 22, 16 are substantially stacked flat upon each other. In a preferred embodiment, the binding means 20 between the fourth planar layer 22 and the third planar layer 16 and between the fourth planar layer 22 and the second planar layer 14 consists of an adhesive material such as glue.

In operation with use for laser target shooting, where a laser may be attached to a pistol or rifle, the laser light enters through and into the third planar layer 16. Light reflects from the second planar layer 14. The third planar layer 16 preferably has a refractive index or cloudiness that will tend to hold a portion of the light therein for illumination purposes by the reflected light. The layered target assembly 10 that is produced by this arrangement is more readily visible in low light conditions than a standard target for conventional sighting is. In bright light conditions, this arrangement enhances the spot produced by the laser on the target thereby making the layered target assembly 10 much more visible than a standard paper target. Various means were discussed for enhancing a particular color such as using color tinted reflective material, colored wax paper or an additional layer such as the fourth planar layer 22. In a preferred embodiment, the binding means 20 between the fourth planar layer 22 and the third planar layer 16 and between the fourth planar layer 22 and the second planar layer 14 consists of an adhesive material such as glue.

The foregoing disclosure and description of the invention is illustrative and explanatory thereof, and it will be appreciated by those skilled in the art, that various changes in the size, shape and materials as well as in the details of the illustrated construction or combinations of features of the various layered target elements may be made without departing from the spirit of the invention.

What is claimed is:

1. A shooting practice layered target assembly, comprising:

a number of planar layers comprising a first planar layer, a second planar layer and a third planar layer positioned closely to each other and being affixed with respect to each other, each of said first planar layer, said second planar layer, and said third planar layer each having a respective planar surface, said first planar layer being sufficiently rigid for supporting said second planar layer and said third planar layer, said second planar layer being positioned between said first planar layer and said third planar layer, said respective planar surface of said second planar layer being comprised of a sheet of reflective metallic foil, said third planar layer being comprised of a sheet of translucent material to allow light to pass therethrough.

2. The layered target assembly of claim 1, further comprising:

a fourth planar layer positioned between said second planar layer and said third planar layer, said fourth planar layer being comprised of a sheet of colored translucent material for passing light of a desired color therethrough.

3. The layered target assembly of claim 1, wherein:

said second planar layer is tinted such that light of a desired color is more readily reflected thereby.

4. The layered target assembly of claim 1, wherein:

said first planar layer is a sheet of paper.

5. The layered target assembly of claim 1, wherein:

said third planar layer is comprised of wax paper.

6. The layered target assembly of claim 1, wherein:

said first planar layer is comprised of a paper product.

7. The layered target assembly of claim 1, further comprising:

an adhesive layer between said first planar layer and said second planar layer for securing said first planar layer and said second planar layer together.

8. The layered target assembly of claim 1, further comprising:

a binding means along at least one outer edge of said first planar layer and along at least one outer edge of at least one of said second planar layer or said third planar layer.

9. A shooting practice layered target assembly, comprising:

a number of planar layers comprising a first planar layer, a second planar layer and a third planar layer positioned closely to each other and being affixed with respect to each other, said first planar layer, said second planar layer and said third planar layer each having a respective planar surface, said first planar layer being sufficiently rigid for supporting said second planar layer and said third planar layer, said first planar layer being comprised of a paper product, said second planar layer being positioned between said first planar layer and said third planar layer, said respective planar surface of said second planar layer being reflective, said third planar layer being comprised of a sheet of sufficiently transparent material to allow light to pass therethrough.

10. The layered target assembly of claim 9, wherein:

said respective planar surface of each of said first planar layer, said second planar layer, and said third planar layer being substantially equal in area.

11. The layered target assembly of claim 9, wherein:

said third planar layer is comprised of wax paper.

12. The layered target assembly of claim 9, wherein:

said second planar layer is comprised of a sheet of metallic foil.

13. The layered target assembly of claim 9, further comprising:

colored means for reflecting a selected color of light.

14. A method for construction of a layered target assembly comprising:

providing a first planar layer consisting of a substantially rigid planar sheet;

affixing a second planar layer having a reflective planar surface to one side of said first planar layer; and affixing a third planar layer to said first planar layer such that said second planar layer is positioned between said first planar layer and said third planar layer, said third planar layer consisting of a sheet of translucent material for allowing light to pass through said third planar layer for reflecting from said reflective planar surface of said second planar layer.

15. The method of claim 14, wherein said step of affixing said third planar layer to said first planar layer further comprises binding together an outer edge of said third planar layer to an outer edge of said first planar layer.

16. The method of claim 14, further comprising:

providing a fourth planar layer that consists of a colored filter between said second planar layer and said third planar layer.

17. The method of claim 14, further comprising:

forming said second planar layer from a sheet of metallic foil.

18. The method of claim 14, further comprising:

forming said first planar layer from a sheet of paper.

19. The method of claim 14, said method further comprising:

gluing said second planar layer to said first planar layer, gluing said second planar layer to the third planar layer, gluing said third planar layer to a fourth planar layer.

20. The method of claim 14, further comprising:

forming said third planar layer from a sheet of wax paper.

* * * * *